US006250593B1

(12) United States Patent
Palu

(10) Patent No.: US 6,250,593 B1
(45) Date of Patent: Jun. 26, 2001

(54) HOLDING AND SUPPORT ELEMENT FOR IRONS

(75) Inventor: Clemente Palu, Susegana (IT)

(73) Assignee: EMMEPI di Manfrenuzzi Maria, Susegana (IT)

( * ) Notice: Subject to any disclaimer, the term of this patent is extended or adjusted under 35 U.S.C. 154(b) by 0 days.

(21) Appl. No.: 09/293,847

(22) Filed: Apr. 19, 1999

(30) Foreign Application Priority Data

Apr. 20, 1998 (IT) ..... PN980026 U

(51) Int. Cl.[7] ..... D06F 79/00
(52) U.S. Cl. ..... 248/117.2; 38/94
(58) Field of Search ..... 38/97, 94, 98; 248/117.6, 117.4, 117.2, 117.3, 117.7; 223/36

(56) References Cited

U.S. PATENT DOCUMENTS

| | | | | |
|---|---|---|---|---|
| 1,656,320 | * | 1/1928 | Crowder | 248/117.6 |
| 1,725,841 | * | 8/1929 | Woodman | 38/97 |
| 1,738,845 | * | 12/1929 | Rollman | 248/117.3 |
| 1,963,858 | * | 6/1934 | Meidell | 38/97 |
| 2,161,009 | * | 6/1939 | Brave | 38/97 |
| 2,299,202 | * | 10/1942 | Bass | 38/97 |
| 2,458,530 | * | 1/1949 | Resnick | 38/94 |
| 2,659,167 | * | 11/1953 | Weldon | 38/97 |
| 2,743,542 | * | 5/1956 | Drummond | 38/97 |
| 2,876,565 | * | 3/1959 | Jacobsen | 38/97 |
| 2,990,635 | * | 7/1961 | Rogers | 38/97 |
| 3,121,965 | * | 2/1964 | McBride | 38/97 |
| 3,785,599 | * | 1/1974 | Ramirez | 248/117.2 |
| 4,209,921 | * | 7/1980 | Kochauf | 38/97 |
| 5,582,374 | * | 12/1996 | Fung et al. | 248/117.2 |
| 5,664,349 | * | 9/1997 | White et al. | 38/97 |
| 5,815,962 | * | 10/1998 | Emberson-Nash et al. | 38/97 |
| 5,987,788 | * | 11/1999 | Doyel | 38/97 |

* cited by examiner

*Primary Examiner*—Ramon O. Ramirez
*Assistant Examiner*—Jon Szumny
(74) *Attorney, Agent, or Firm*—Dowell & Dowell, P.C.

(57) ABSTRACT

A holding and support element for electric irons which includes a protective support formed of a heat insulating material which may be placed against an ironing plate and which includes a bottom wall and side walls which are formed to define a housing for receiving the ironing plate such that the support will remain secured to the ironing plate regardless of movement of the ironing to thereby prevent injury from accidental contact with the ironing plate.

17 Claims, 5 Drawing Sheets

HOLDING AND SUPPORT ELEMENT FOR IRONS

CROSS REFERENCE TO RELATED APPLICATIONS

This application claims priority benefit from Italian patent application PN98 U 000026 which was filed on Apr. 20, 1998.

BACKGROUND OF THE INVENTION

1. Field of the Invention

The invention relates to a holding and support element for irons, designed to hold irons of different sizes that are still hot after their use, and to hold such irons in such a manner as to prevent possible harm and damage to individuals and objects who may have come into accidental contact with them.

2. Brief Discussion of the Related Art

Known at present are support elements for irons that are generally constituted by suitable small mats made out of cloth, rubber or other insulating material, provided on the handle ofthe iron, or in other appropriate positions, and on which the irons rest in the condition in which they are, either during the periods when they are not in use or upon having used them. This means that the irons are still very hot and, therefore, their ironing bottom-plate is removed from the support surface, preventing thus an overheating ofthe surface itself without, however, averting the danger that individuals and objects come into contact with their surface, thus suffering burns.

SUMMARY OF THE INVENTION

The present invention has as object the elimination of the drawbacks and the limitations resulting from the use of said mats by means of a holding and support element for irons, designed to effectively and quickly hold irons of different sizes immediately after their use. Thus are prevented the dangers of eventual accidental contacts by individuals or objects with the ironing surface, avoiding the possible damages resulting therefrom, further offering the possibility of placing the holding element with the iron in various positions.

This holding and support element is designed with the structural characteristics essentially described herein, with special reference to the attached claims.

The invention will be better understood from the below description, given only by way of a not limited example and with reference to the illustrations wherein:

DESCRIPTION OF THE PREFERRED EMBODIMENTS

Figure 1:
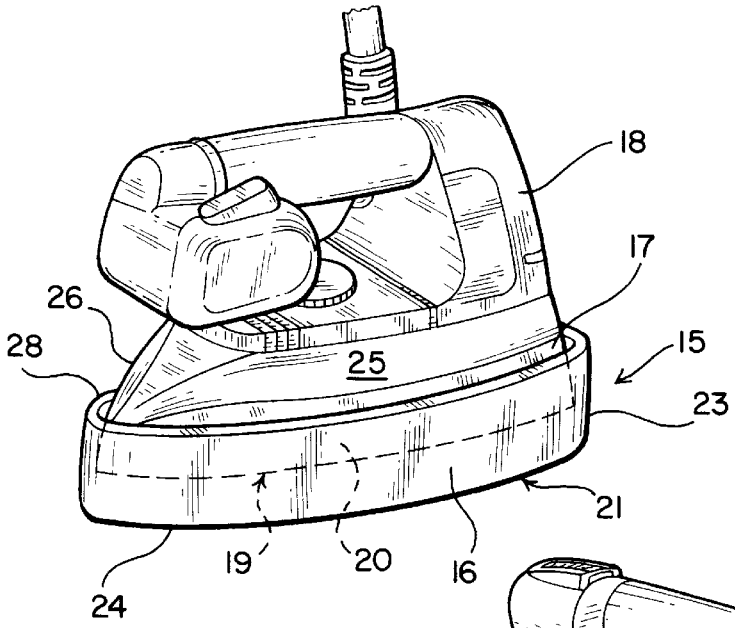
FIGS. 1 and 2 show a view in perspective of two different positions of the holding and support element in accordance with the invention, in a first embodiment.

Above illustrations show diagrammatically a holding and support element 15 in accordance with the invention, designed for irons of different sizes, still hot after having been used and also after successive periods of time. This holding and support element is essentially constituted by a protective support 16, made out of one or various pieces of a heat-insulating material such as, for example, rubber, cloth, plastic or the like, formed and dimensioned to be adapted to the shape and size of the ironing bottom-plate 17 of a conventional electric iron 18, so as to cover the entire surface of the bottom 19 of this bottom-plate, intended for the ironing, and the entire peripheral border 20 up to a certain height of same, preventing in such a manner any external contacts with said ironing surface. Further, this protective support has a thickness appropriate to prevent or greatly reduce the transmitting towards the outside of the heat produced by the ironing plate 17, during or immediately after the ironing phase, while this plate is still extremely hot. In the below illustrations are described, by way of example, various possible embodiments of this holding and support element.

Figure 2:
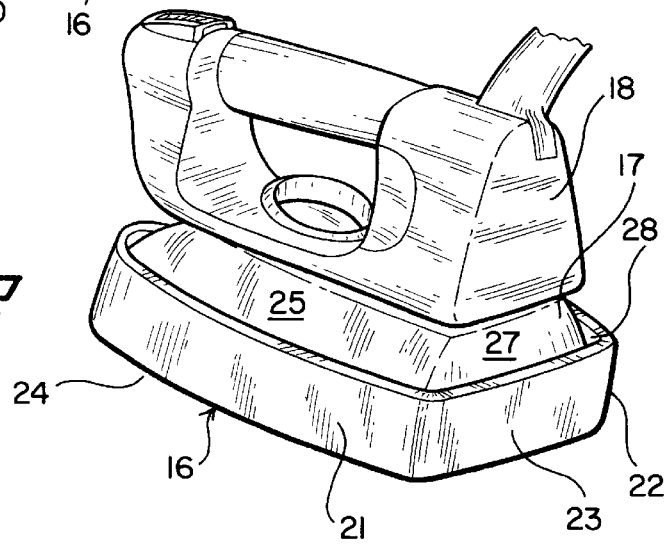

Particularly, in FIGS. 1 and 2 can be observed that the protective support 16 (which in this case is rubber) is made out of one piece presenting three peripheral walls 21, 22 and 23, joined to each other and having a flat bottom piece 24, formed in the shape of the ironing bottom-plate 17 of the iron in order to cover it. The walls 21 and 22 cover the front and back sections 25 and 26 of this plate and the wall 23 covers the lateral side 27 of said plate, while the wall 24 covers the surface of the bottom 19 of the plate. Further, this protective support is of such size as to allow the inserting with a slight pressure of the ironing bottom-plate 17 of the iron 18 in the corresponding open housing 28 between the walls 21–24 so as to hold the iron, preventing in a reliable manner any contact with its still hot ironing bottom-plate and avoiding thus any possibility of injury or damage to individuals or objects, and allowing the placing of the holding and support element with the iron in any position of support, thanks to the tight fit of the protective support against the ironing bottom-plate.

Figure 3:
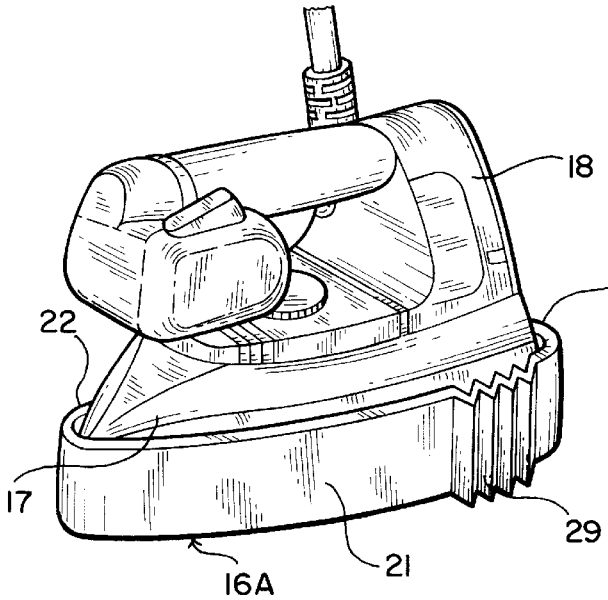
FIGS. 3 and 4 show in the same view as above the present holding and support element in a second embodiment.
Figure 4:
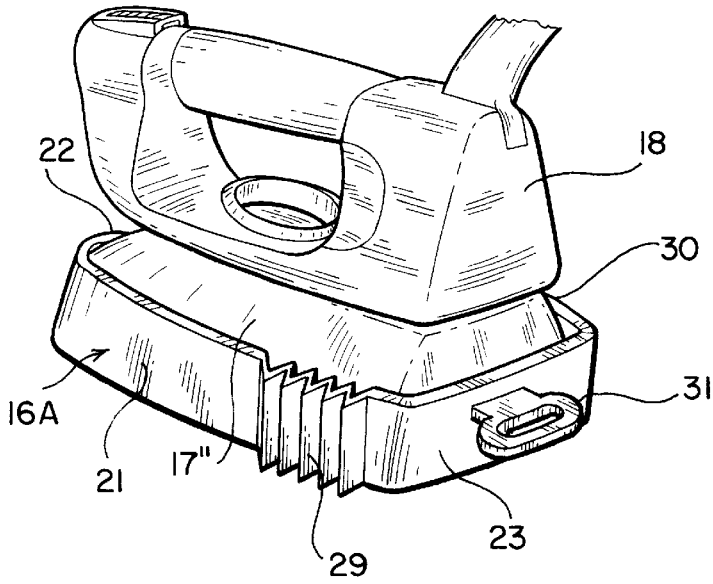

In FIGS. 3 and 4 it can be observed that the protective support 16A is essentially similar to that of the foregoing illustrations and it differs only in that the front wall 21 and the back wall 22 are pleated over a section of their extension, defining thus the pleated area 29, 30 that allows a lengthening or a shortening, within certain limits, of the protective support itself, adapting it to irons of different sizes. Further, in the example it can also be noted that the lateral wall 23 of the protective support 16 extends with a protruding grip 31 that can be grasped to facilitate the insertion and removal of the iron from the protective support.

Figure 5:
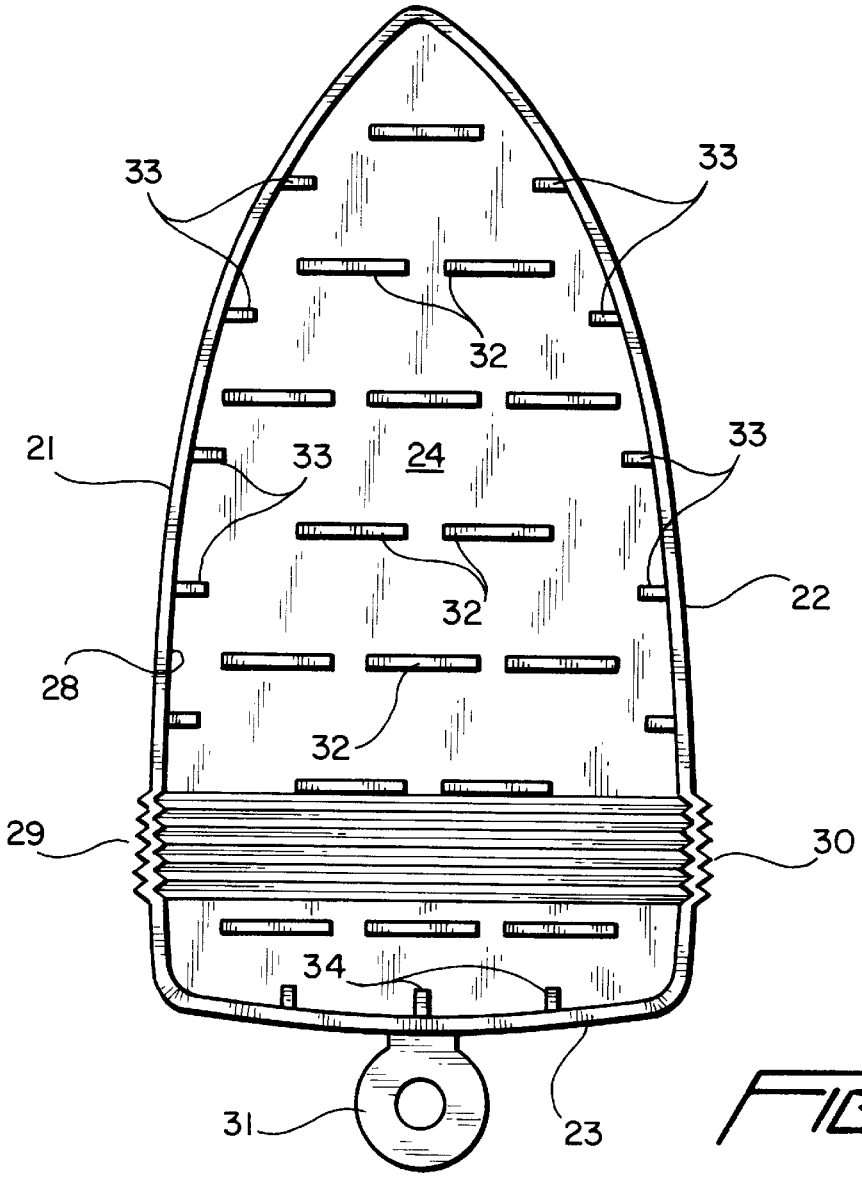
FIG. 5 shows a plane view of the holding and support element illustrated in FIGS. 3 and 4.
Figure 6:
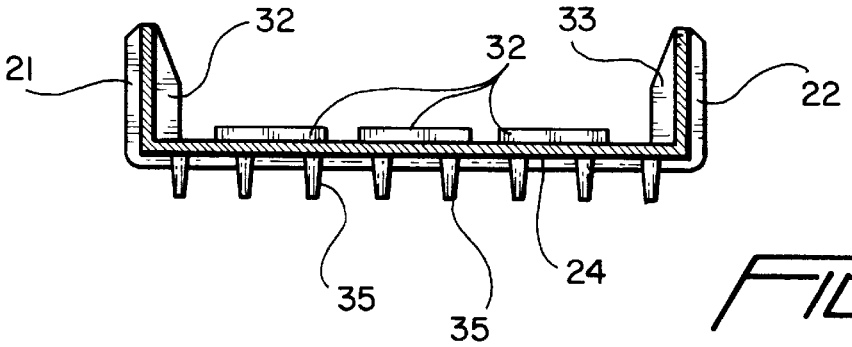
FIG. 6 shows an end view of the holding and support element of FIG. 5, along the line A—A.

FIGS. 5 and 6 show in more detail the design of the protective support illustrated in FIGS. 1, 2, 3, and 4, and from these illustrations can be gathered that its bottom piece 24 and its front wall 21, its back wall 22 and lateral wall 23 are provided with various series of ribs 32, 33 and 34 protruding from same and appropriately distanced from each other with respect to the open housing 28 of the support itself. The purpose is either for the inserting with a slight pressure of the ironing bottom-plate of any iron and the fitting against such plate, because of the above-mentioned reasons, a greater distance of the plate from the outside surfaces of the support is created, so as to increase the insulating capacity of the support. The various series of ribs 35, protruding from the surface facing the bottom wall and oriented towards the support surface of this protective support, facilitate the fitting against the support surface while impeding undesired shifting of the support-iron unit from its position and, also, to increase the insulating capacity.

Figure 7:
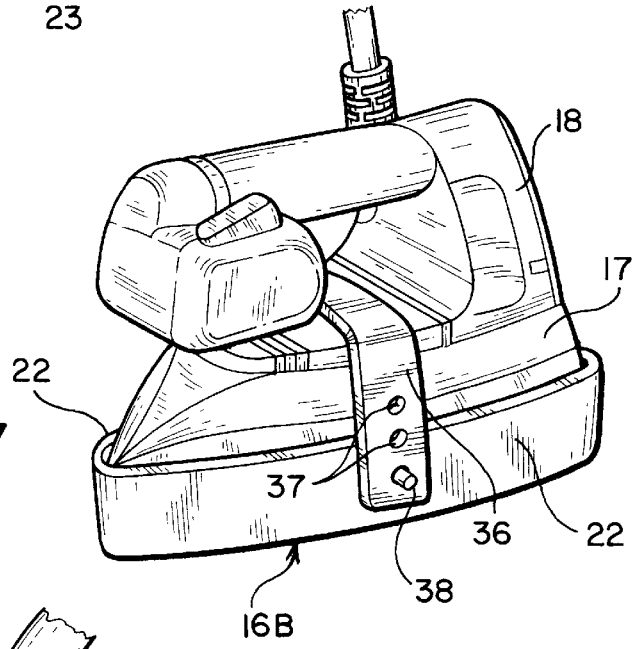
FIGS. 7 and 8 show a view in perspective of two different positions of the holding and support element in accordance with the invention, in a third embodiment.
Figure 8:
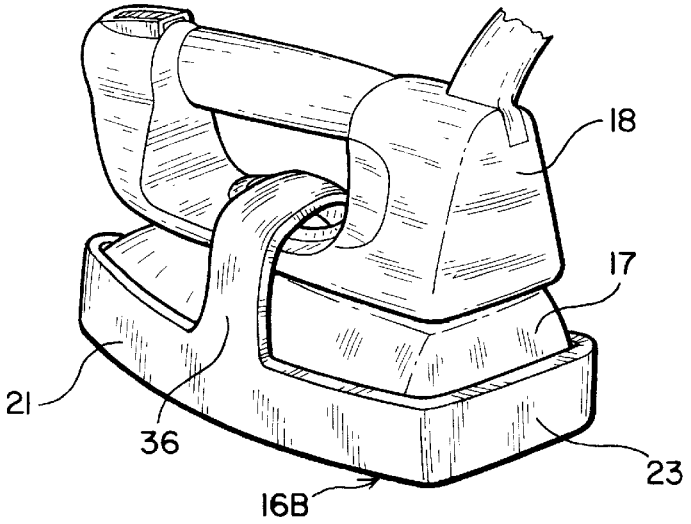

In FIGS. 7 and 8 can be observed that the protective support 16B is provided with at last one strap 36 for the holding of the iron, joined at one of its extremities to one of the peripheral walls of the support itself. In this case it is joined to the front wall 21, while the other extremity is free and provided with a series of holes 37 that are axially distanced from each other, designed to selectively fit over a corresponding button 38 protruding from the other peripheral wall of the protective support, in this case from the back wall 22, after having passed the strap around the ironing plate 17 and adapted to the respective size of said plate, thus binding the iron to the protective support.

Figure 9:
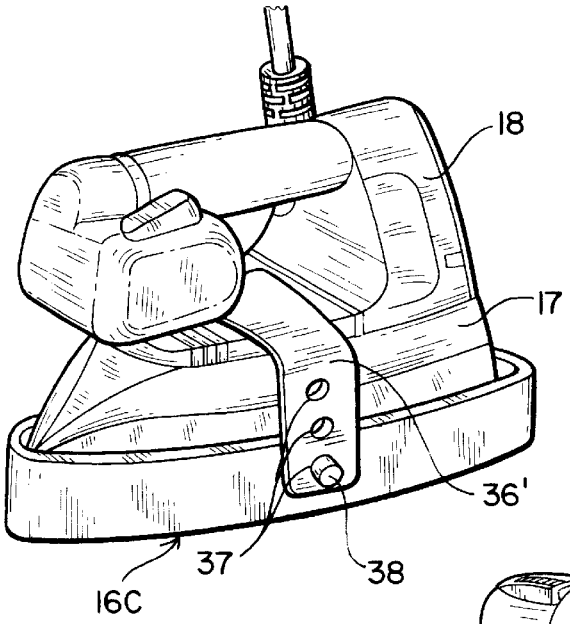
FIGS. 9 and 10 show in the same view as that of FIGS. 7 and 8 the holding and support element in accordance with the invention, in a fourth embodiment.
Figure 10:
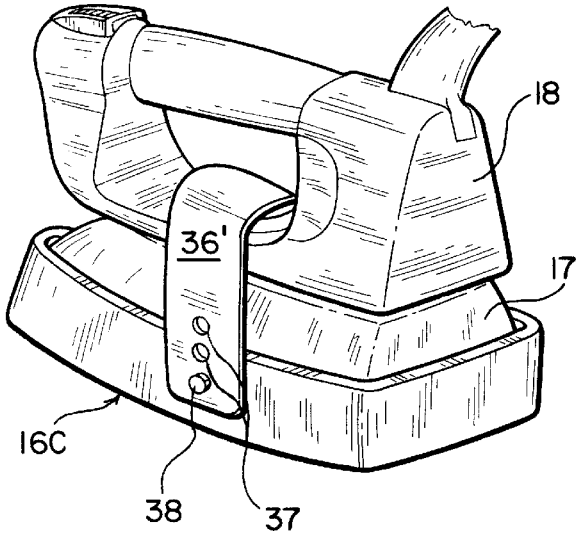

In FIGS. 9 and 10 it can be observed that, like in FIGS. 7 and 8, the protective support 16C is also provided with a binding strap 36' that, however, in this case is separated from the support itself to be adapted around the ironing plate 17 of the iron, at the extremity of which are shaped or clasped in position in a manner identical to the free extremity of above-mentioned strap.

Figure 11:
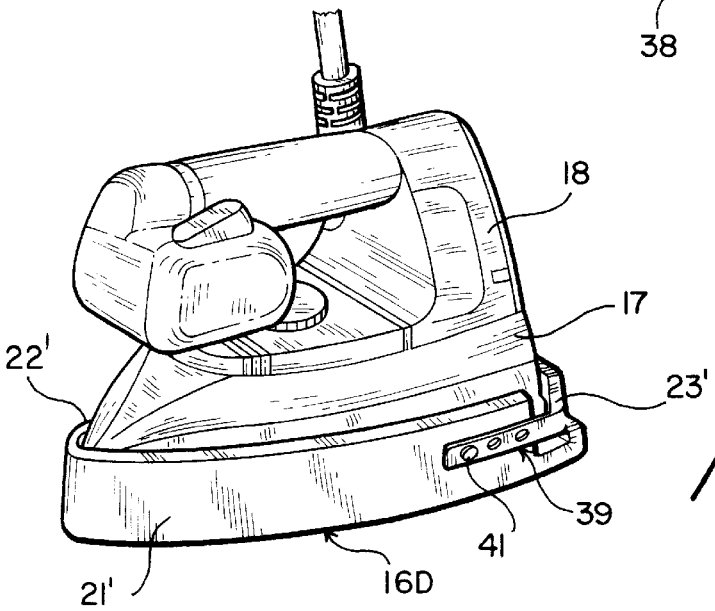
FIGS. 11 and 12 show in the same view as that of 7 to 10 the holding and support element in accordance with the invention, in a fifth embodiment.
Figure 12:
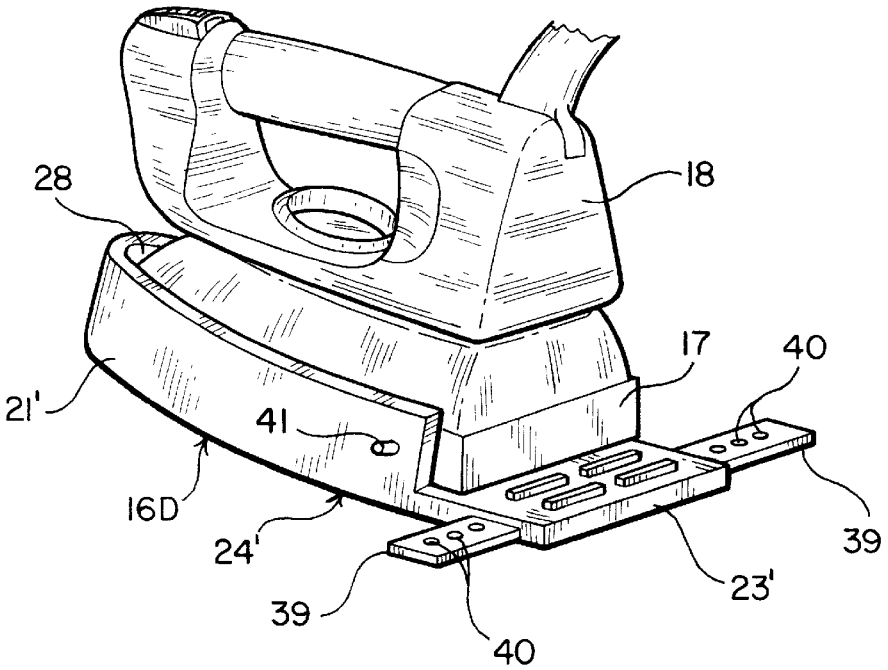

In FIGS. 11 and 12 it can be observed that the protective support 16D is essentially similar to the one described in FIGS. 1 and 2, except for the fact that in this case it is provided with a lateral wall 23' that can be coupled to and uncoupled from the adjacent front and back walls 21' and 22' of the support itself, in order to allow, at first, the insertion of the iron into the open housing 28 and then the holding of the iron in the position of insertion.

Therefore, in the example in question, the lateral wall 22' is designed as an extension of the bottom wall 24 and it is provided on the two sides with protruding tongues 39 in which are axially provided various holes 40, designed to selectively catch in pertinent pegs 41 laterally protruding from both walls 21' and 22', subsequent to the pleating of this lateral wall and the adapting of the same to the walls 21' and 22' depending on the length of the ironing plate of each iron.

Figure 13:
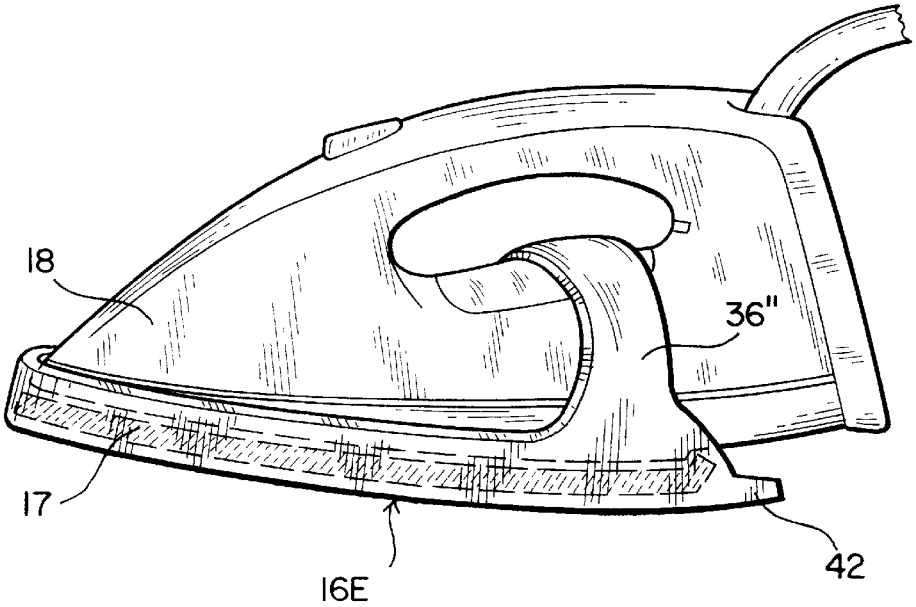
FIG. 13 shows a view in perspective a holding and support element in a sixth embodiment.

Lastly, in FIG. 13 it can be observed that the protective support 16E is similar to that of FIGS. 11 and 12, save for the fact that the lateral wall is provided with a lateral extension 42 to directly receive the ironing bottom-plate 17 of the iron, as well as with a binding strap 36" of the same type and having the sane function as described with reference to FIGS. 7, 8 and 9, 10. In this case, this protective support is designed as a general type for the inserting of irons of whatsoever size, which therefore are easily and quickly placed in position.

Of course, the holding and support element designed in this manner can also be designed in other manners than described herein by way of example, provided that the components of the protective support of the type and for the above-mentioned functions, have the possibility of being adapting to irons of different sizes without, however, going beyond the scope of protection of the present invention.

What is claimed is:

1. A holding and support element adapted for use with irons that are not in use having an ironing plate, the holding and support element including at least one protective support constructed of an imperforate heat insulating material of a type which is adapted to be placed against a hot surface of the ironing plate and which provides a barrier to prevent the passage of potentially dangerous heat from the ironing plate therethrough, said at least one protective support including a bottom wall and first and second upwardly extending side walls and which walls define therebetween a housing of a size to cooperatively receive the ironing plate therein, whereby said at least one protective support provides a heat insulating barrier to prevent accidental burns or burning of objects when said at least one protective support is mounted to the ironing plate.

2. The holding and support element for irons of claim 1 in which said side walls diverge outwardly relatively to one another from adjacent one end of said at least one protective support toward an opposite end thereof and are yieldable with respect to one another to thereby adapt said side walls to frictionally grip and retain side portions of the ironing plate when the ironing plate is introduced into said housing.

3. The holding and support element of claim 2 including a plurality of ribs extending inwardly of said housing from said side walls to thereby provide heat insulating open spaces there between.

4. The holding and support element of claim 3 including a plurality of ribs extending inwardly of said housing from said bottom wall.

5. The holding and support element of claim 4 including an end wall extending between said side walls along said opposite end of said at least one protective support.

6. The holding and support element of claim 5 including a plurality of spaced ribs extending inwardly of said housing from said end wall.

7. The holding and support element of claim 6 wherein said bottom wall and said side walls include a pleated zone for allowing expansion of said at least one protective support.

8. The holding and support element of claim 7 including a grip member extending from said end wall oppositely said housing for facilitating expansion of said pleated zone.

9. The holding and support element of claim 2 including a strap member extending between said side walls and means for adjustably securing said strap member relative to said side walls.

10. The holding and support element of claim 2 wherein said bottom wall and said side walls include a pleated zone for allowing expansion of said at least one protective support.

11. The holding and support element of claim 2 including an end wall extending between said side walls along said opposite end of said at least one protective support.

12. The holding and support element of claim 11 including means for adjustably securing said end wall relative to said side walls.

13. The holding and support element of claim 11 wherein said bottom wall and said side walls include a pleated zone for allowing expansion of said at least one protective support.

14. The holding and support element of claim 13 including a strap member and means for adjustably connecting said strap member relative to said side walls.

15. The holding and support element of claim 5 including means for adjustably securing said end wall relative to said side walls.

16. The holding and support element of claim 7 including a plurality of spaced ribs extending from an outer surface of said bottom wall.

17. The holding and support element of claim 7 including a, strap member and means for adjustably securing said strap member relative to said side walls.

* * * * *